US006449455B1

(12) United States Patent
Lebold et al.

(10) Patent No.: US 6,449,455 B1
(45) Date of Patent: Sep. 10, 2002

(54) RELEASE AGENT DELIVERY SYSTEM FOR USE IN PRINTER DEVICES

(75) Inventors: Alan Lebold; Jason Palazzo, both of Niagara Falls, NY (US); Neil Graham Dugdale, Evans, GA (US)

(73) Assignee: BMP America, Inc., Medina, NY (US)

( * ) Notice: Subject to any disclaimer, the term of this patent is extended or adjusted under 35 U.S.C. 154(b) by 0 days.

(21) Appl. No.: 09/450,759

(22) Filed: Nov. 30, 1999

(51) Int. Cl.[7] ..... G03G 15/20
(52) U.S. Cl. ..... 399/325
(58) Field of Search ..... 399/324, 325, 399/326, 327; 118/60

(56) References Cited

U.S. PATENT DOCUMENTS 4,309,957 A * 1/1982 Swift ..... 118/60
4,324,482 A * 4/1982 Szlucha ..... 399/327
5,045,890 A 9/1991 Debolt et al.
5,327,203 A 7/1994 Rasch et al.
5,343,278 A * 8/1994 Nakabayashi et al. ..... 399/326
5,649,130 A * 7/1997 Nakajima et al. ..... 399/327

FOREIGN PATENT DOCUMENTS

JP 07-302026 * 11/1995
JP 10-116011 * 5/1998

OTHER PUBLICATIONS

The Oil Delivery Uniformity Of A BMP Thermal Bonded Nonwoven Oiling Web Compared . . . BMP America Inc. Alan Lebold and Jason Palazzo, Nov. 30, 1999.

* cited by examiner

*Primary Examiner*—Robert Beatty
(74) *Attorney, Agent, or Firm*—Jones, Tullar & Cooper, P.C.

(57) ABSTRACT

A release agent delivery system for an electrophotographic printing process utilizes a web which is a non-woven textile comprised of substantially all sub-denier fibers. The release agent delivery system using the textile produced with predominantly sub-denier fibers, creates finer oil flow patterns which yield improved print quality though decreased microscopic streaking.

16 Claims, 10 Drawing Sheets

RELEASE AGENT DELIVERY SYSTEM FOR USE IN PRINTER DEVICES

FIELD OF THE INVENTION

The present invention is directed generally to a release agent delivery system for use in an electrophotographic printing process. More particularly, the present invention is directed to the use of a non-woven textile web for use as a release agent delivery device in a release agent delivery system. Most specifically, the present invention is directed to the use of a non-woven thermally bonded textile web of essentially sub-denier fibers in a release agent delivery system. The use of the textile web of sub-denier fibers provides very fine release agent flow patterns that yield highly improved print quality through decreased microscopic streaking of the release agent.

DESCRIPTION OF THE PRIOR ART

In the process of electrostatic printing, a latent electrostatic image is recorded on a photosensitive member with subsequent rendering of the image visible by the application of electrostatic marking particles, typically referred to as toner. The visual image formed by the toner particles is then transferred from the photosensitive member to a sheet of paper with subsequent affixing of the toner particles onto the paper.

To fix or fuse the toner particles onto the paper permanently by heat, the temperature of the toner particles is elevated to a point at which the constituents of the toner coalesce and become tacky. This causes the toner to flow to some extent into the fibers or pores of the paper. As the toner cools, solidification of the toner occurs, causing the toner to be bonded firmly to the paper.

One method of thermally fusing toner particles onto the paper is to pass the paper, with the unfused toner particles thereon, between a pair of opposed roller members, at least one of which is internally heated. During the operation of a fuser system of this type, the paper to which the toner particles has been electrostatically adhered, is moved through the nip formed between two rolls with the toner particles contacting the heated user roll to thereby effect heating of the toner particles within the nip. Typically these fuser systems contain two rolls, the fuser roll and the compression roll. The fuser roll is typically coated with a compliant material, such as silicone rubber, low surface energy elastomers, or polytetrafluoroethylene (PTFE) resin sold by E. I. DuPont De Nemours under the trademark TEFLON. One drawback of these prior art fuser systems is that since the toner particles are tackified by heat, part of the particles forming the image carried on the paper are often retained by the heated fuser roller rather than penetrating the paper's surface. This tackified toner often sticks to the surface of the fuser roller and then gets deposited onto the following paper or onto the mating pressure roller. This depositing of toner onto the following paper is known as "offsetting". Offsetting is an undesirable occurrence which lowers the sharpness and quality of the immediate print as well as contaminating the following prints with toner.

To alleviate the toner offsetting problem, it is common practice to utilize release agents, such as silicone oils which are applied to the fuser roll surface to act as a toner release material. These toner release agents possess a relatively low surface energy and are suitable for use in the heated fuser roll environment. In practice, a thin layer of silicone oil is applied to the surface of the heated fuser roll to form an interface between the fuser roll surface and the toner particles carried on the support material or paper. Thus, a low surface energy, easily parted layer is presented to the toners that pass through the fuser nip and thereby prevents toner from adhering to the fuser roll surface.

Numerous systems have been used to deliver toner release agents, such as silicone to the fuser roll. These systems typically incorporate a textile as the release agent fluid or oil holding and delivery medium. These textiles also serve a critical roll in that they are utilized as a fuser roller cleaning mechanism. With each rotation of the fuser roller, there may be some non-released toner particles remaining on the surface of the fuser roller. These non-released toner particles are then captured in the interstices of the textile fibers as the textile moves relative to the rotating fuser roller.

One of the more commonly used textiles in electrophotographic printing machines is known as a thermal bonded non-woven textile. Other textiles include those known as spun bond non-wovens and hydroentangled non-wovens. Many of the textiles used in electrophotographic printing machines are typically made with some content of polyester fibers and Aramid fibers. These textiles are also sometimes made of Imide, polyphenylene sulfide (PPS), PTFE, and viscose rayon fibers. The textiles are typically impregnated with a silicone oil such as those sold by the Dow Corning Corporation. Many of these silicone oil impregnated textiles are manufactured at BMP America Incorporated located in Medina, N.Y. and Portland, Oreg., or at BMP Europe Limited located in Accrington, Lancashire, United Kingdom.

Although these oil impregnated textiles meet most application requirements, some applications demand improved image quality. In an effort directed to having an electrophotographic print approach the image quality of a traditional silver halide developed photograph, every step towards improved electrophotographic print quality is critical in today's market. Certain image or print quality issues still exist with the presently used textile materials. Under most conditions, current textile materials create silicone oil flow patterns on the fuser roller, which oil flow patterns correspond to high, low, and void areas of the textile's fibers. These oil flow patterns are circumferentially positioned on the fuser roller's surface with high oil flow patterns corresponding to the textile's fiber void regions and with low oil flow patterns corresponding to the textile's high fiber regions. These microscopic oil streaks get transferred to the printed page thereby creating microscopic image variations. These microscopic image variations are in the form of alternating lines of gloss and matte finish. An image's appearance is created by the combination of substrate type, i.e. paper, transparency, card stock, toner type, printing process, and oil quantity. Pages printed with heavy oil appear to have a glossy finish, pages printed with light oil appear to have a matte finish, and pages printed with non-uniform oil appear to have a non-integrated finish, the result of alternating glossy and matte finish areas. These non-uniformity finishes are very undesirable in printed pages. As these non-uniform finish areas become smaller, they become more difficult to notice. Every step towards decreasing their size is a step towards improving print quality.

SUMMARY OF THE OF INVENTION

It is an object of the present invention to provide a release agent delivery system for use in an electrophotographic printer.

Another object of the present invention is to provide a non-woven textile fabric web useable as a release agent delivery device.

A further object of the present invention is to provide a non-woven thermally bonded textile web of essentially sub-denier fibers useable as a release agent delivery device.

Still another object of the present invention is to provide a release agent delivery web which will reduce non-uniform finishes on printed pages.

Yet a further object of the present invention is to provide a release agent delivery system which yields a finer, more uniform circumferential release agent pattern on the fuser roller of an electrophotographic printer.

In accordance with the present invention, the release agent is delivered to the fuser roller by a non-woven thermally bonded textile web of essentially sub-denier fibers. These sub-denier fibers provide much improved uniformity of the release agent delivered to the surface of the fuser roller. Instead of alternating visible areas of matte and glossy finish on the print, the deliver of the release agent by the non-woven essentially sub-denier finish textile web in accordance with the present invention results in a much more uniform pattern of release agent delivery to the fuser roller. This more uniform release agent delivery pattern results in a much more uniform finish of the resultant print.

The sub-denier fibers of the non-woven textile web used in the present invention provide a textile with a finer topographical surface. The textile's surface drags on the fuser roll surface in an oil filled environment. The textile's finer topographical surface yields a finer circumferential oil pattern, or a pattern with a thinner band width, on the fuser roll surface. As the toner is being fused onto the page, the oil residing on the fuser roller is absorbed into the page. The textile web used in the present invention allows for a much finer pattern of oil, with a much thinner band width, to be absorbed into the page.

Finer width and thus more uniform oil patterns absorbed into the printed page dramatically increase the printed image quality by decreasing the individual bar width of the alternating gloss/matte/gloss/matte regions on the printed page. The decrease in size of the individual bar widths of alternating gloss/matte/gloss/matte regions leads to a more integrated appearance on the printed page. The effects of the present invention are most visibly noticeable in full color prints. These improvements are especially important in the ever quickening race toward achieving traditional photographic or silver halide quality in an electrophotographic print.

In attaining these objectives the present invention utilizes, in one embodiment, a textile web of substantially sub-denier fibers with the web weighing in the range of 10 to 150 grams/square meter and being comprised of greater than 50% fibers which are sub-denier in size. The textile web may be produced by thermal bonding, spun bonding, needle felting, melt blowing, or hydroentanging. The textile is impregnated with release agent which is typically silicone oil to a level of 2.5 to 250 grams/square meter. The resultant release agent delivery system provides greatly improved print quality as a result of the significantly improved uniformity of the toner release agent flow pattern applied to the fuser roller. The present invention is a substantial advance in the art.

BRIEF DESCRIPTION OF THE DRAWINGS:

While the novel features of the release agent delivery system for electrophotographic printers in accordance with the present invention are set forth with particularity in the appended claims, as full and complete understanding of the invention may be made by referring to the detailed description of the preferred embodiments, as presented subsequently, and as illustrated in the accompanying drawings in which:

DETAILED DESCRIPTION OF THE PREFERRED EMBODIMENT

Figure 1:
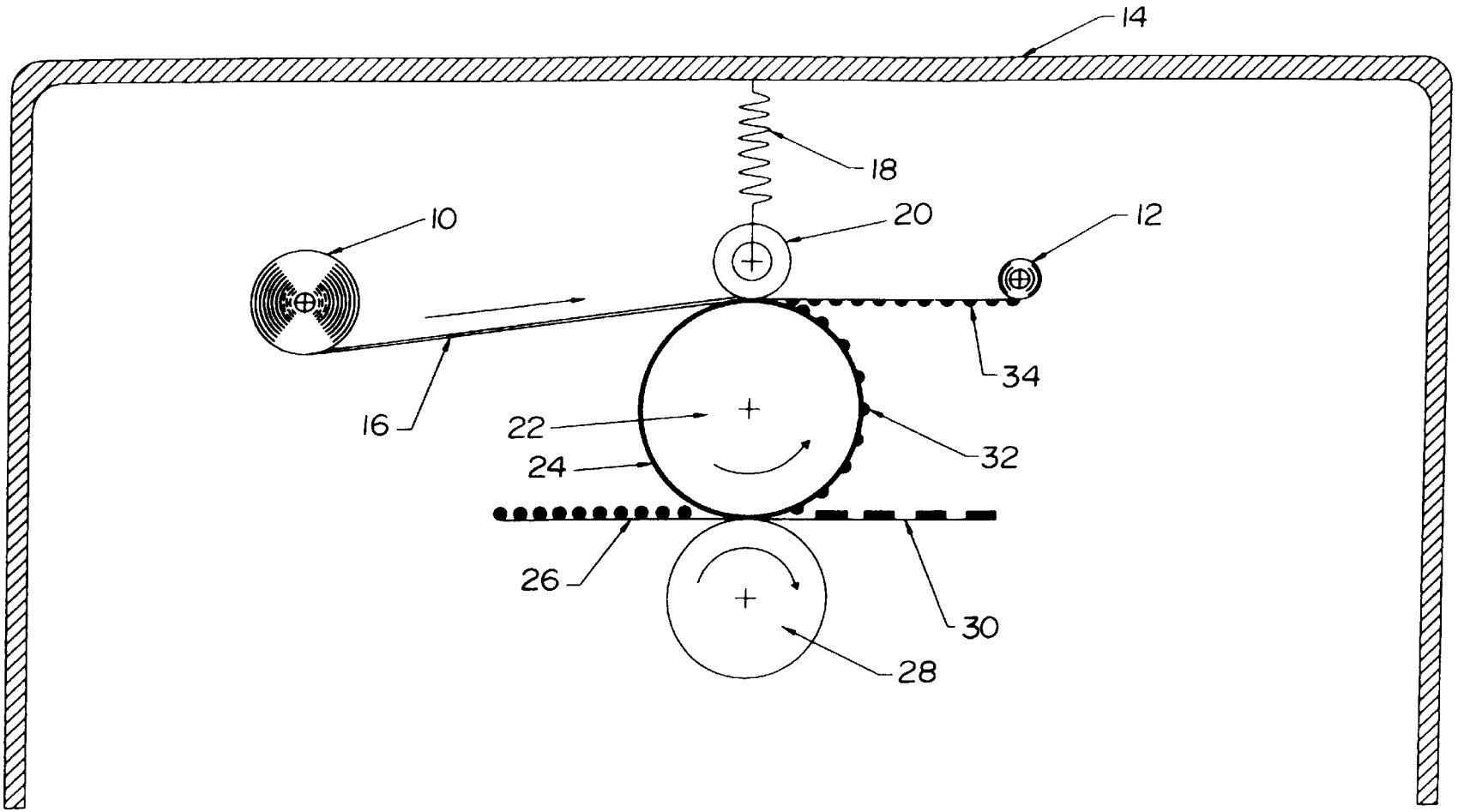
FIG. 1 is a side elevation view of a release agent delivery device using a non-woven textile fabric for delivery of a release agent in accordance with the present invention.

Referring initially to FIG. 1, there may be seen a release agent delivery device useable in the non-woven textile web release agent delivery system of the present invention. An unused release agent impregnated non-woven textile web supply spool 10, which is referred to as the "supply" spool in the electrophotographic printing industry is shown. An opposing spool 12, referred to as the take up spool, is used to receive the used portion of a release agent impregnated, non-woven textile web 16 which is supplied from the supply spool 10. A cassette housing 14, typically constructed of plastic or metal, serves as the mechanical support for the web assembly 10, 12, and 16. The release agent impregnated web 16 is compressed by a compression roller 20 that is urged by a spring 18 into contact with the web 16 and which squeezes release agent out of the web 16 onto a fuser roller 22, more specifically onto a surface 24 of the fuser roller 22. A page 26 with unfused toner enters a nip point between the fuser roller 22 and a pressure roller 28 and exits this nip point as a printed page with fused toner 30. The toner 30 becomes fused onto the printed page due to the exerted pressure and temperature exposure at the nip point between the fuser roller 22 and the pressure roll 28. Residual toner 32 is then carried on the fuser roller 22 and is transferred to the web surface 34 of the release agent impregnated web 16 which contacts the surface 24 of the fuser roller 22.

Figure 2:
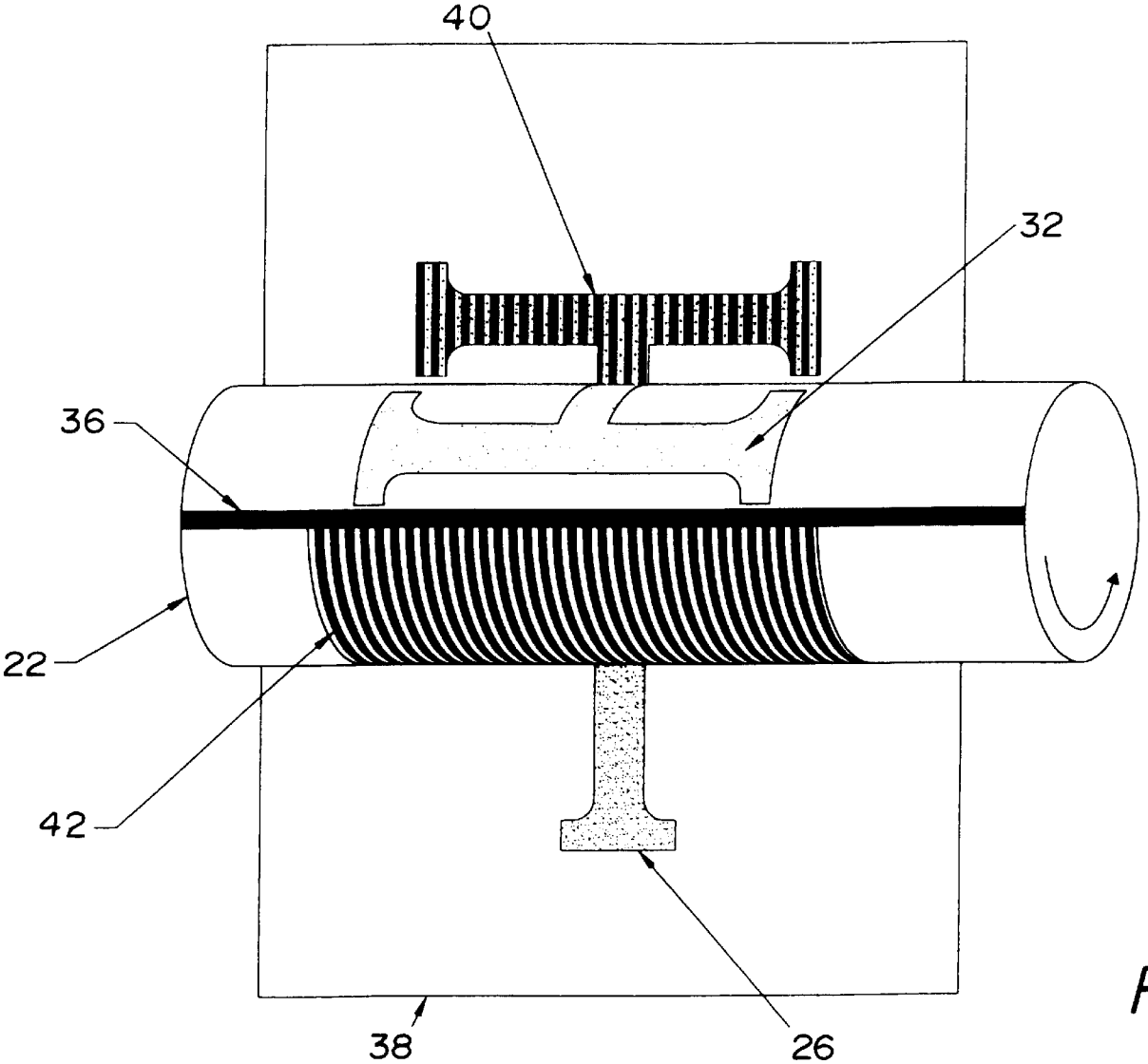
FIG. 2 is a top plan view of a partially toner fused print showing an image with alternating matte and glossy finish areas.

As depicted in FIG. 2, which is a view of the fuser roller 22 looking from a nip point 36 between the web 16 and the fuser roller 22 towards the paper or similar substrate 38, an image 40, such as a capital letter T, is 50% unfused toner 26 and 50% fused toner 30. The unfused toner 26 residing on the paper 38 is entering the fusing zone and the fused toner 30 on the paper 38 is exiting the fusing zone. The fused toner 30 is depicted as alternating black and gray stripes to emphasize the alternating gloss and matte finish that one can visually detect in many electrophotographic prints. Residual toner 32 is being carried on the fuser roller 22 toward the web's nip point 36. At the web's nip point 36 the residual toner 32 will be removed and release agent will be deposited onto the fuser roller 22. Circumferential flow patterns 42 of release agent are depicted by black and white stripes and are actually high and low release agent concentration stripes created by low and high points in the topographical surface of the release agent impregnated non-woven textile web 16. It is the circumferential release agent flow patterns 42 that the present invention is directed to minimizing or diminishing by decreasing their size.

Figure 3:
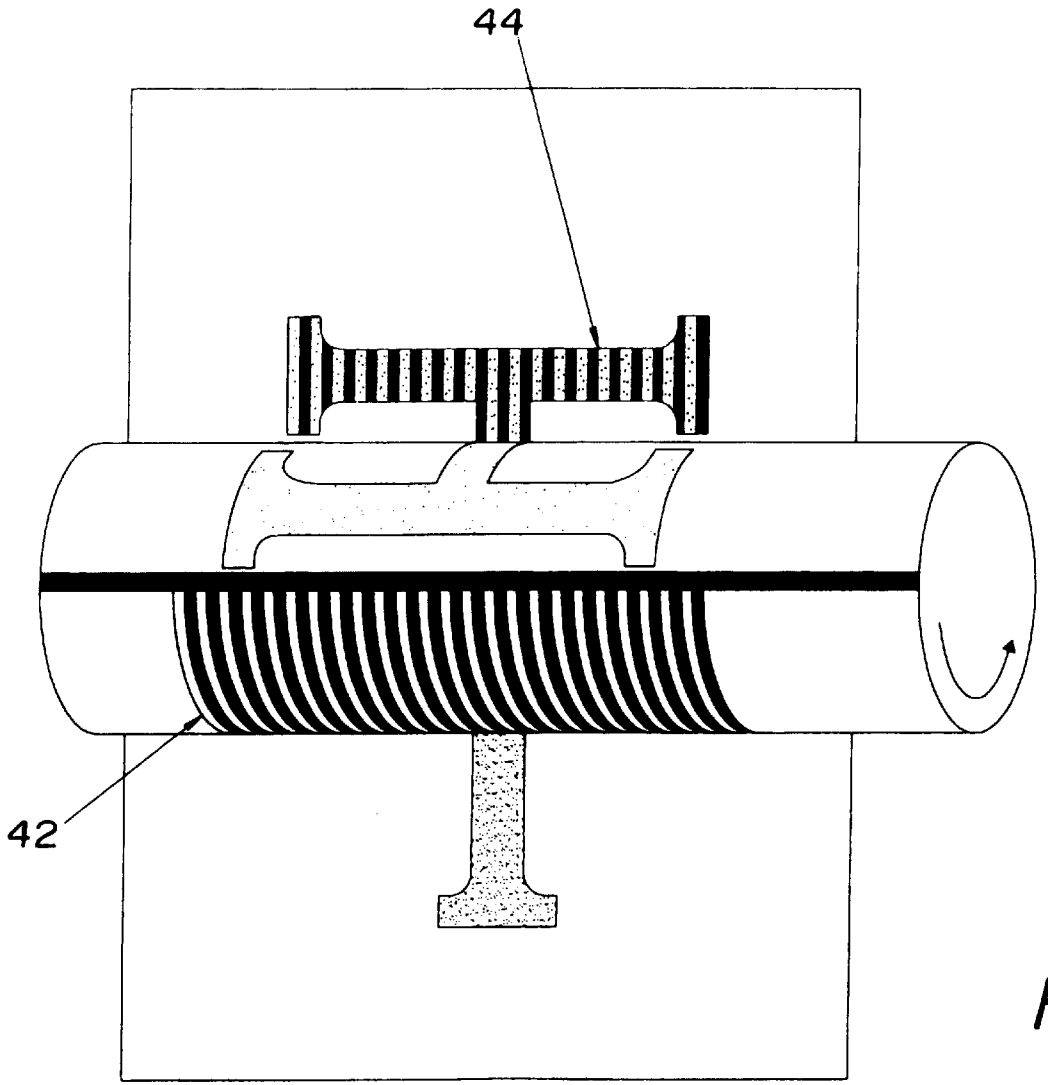
FIG. 3 is a view similar to FIG. 2 and showing the image resulting from the use of a coarse denier fiber web.

In FIG. 3, there is depicted a view similar to FIG. 2, and showing a 50% fused image of a capital letter T that has been generating utilized a prior art coarser denier fiber textile as the release agent delivery device thus creating coarse release agent flow patterns 42 depicted by coarse black and white stripes. Again, the black and white stripes are actually high and low release agent concentration stripes created by low and high points in the textile's topographical surface. The fused toner 44 is depicted as course alternating black and gray stripes to emphasize the course alternating gloss and matte finish that one can visually detect in many electrophotographic prints that have been produced with prior art textile release agent delivery systems.

Figure 4:
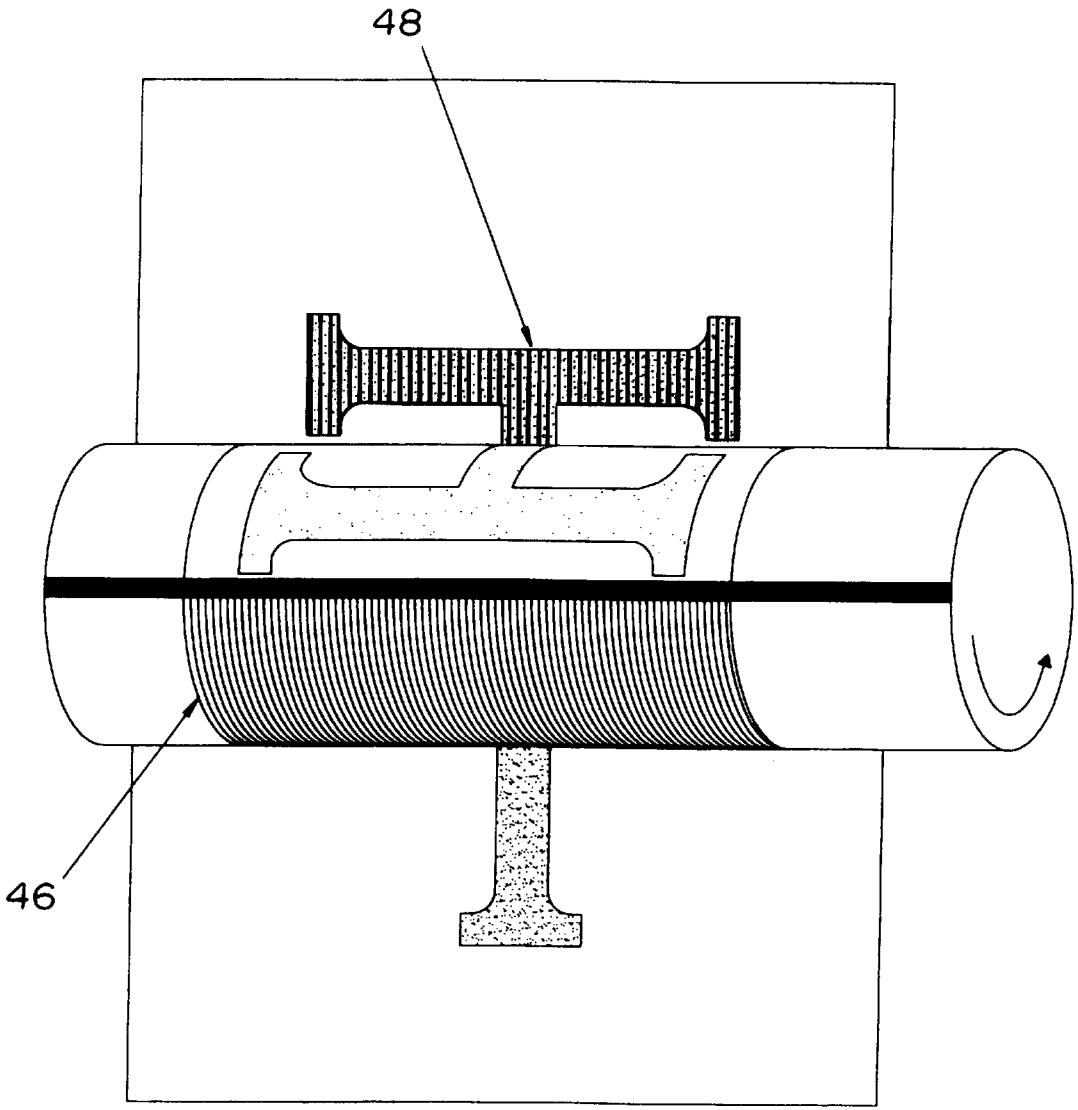
FIG. 4 is a view similar to FIGS. 2 and 3 and showing the image resulting from the use of fine denier fiber web in accordance with the present invention.

Turning now to FIG. 4, there is presented a view similar to FIGS. 2 and 3 and showing a 50% fused image of a capital letter T in accordance with the release agent delivery system of the present invention which utilizes finer denier fiber textiles to create or form fine release agent flow patterns 46 depicted by fine black and white stripes. Again, the black and white stripes are actually high and low release agent concentration stripes created on the fuser roller 22 by low and high points in the topographical surface of the non-woven thermally bonded textile web of essential sub-denier fibers used in the release agent delivery system of the present invention. The fused toner 48 is depicted in FIG. 4 as fine alternating black and gray stripes to emphasize the fine alternating gloss and matte finish. This fine alternating gloss and matte finish is much more difficult to visually detect in electrophotographic prints. The improvement in the electrophotographic prints in accordance with the present invention will be quantified by measuring the width of the release agent deposited onto the page and by comparing these measurements to measurements made from prints using prior art release agent delivery systems.

Figure 5:
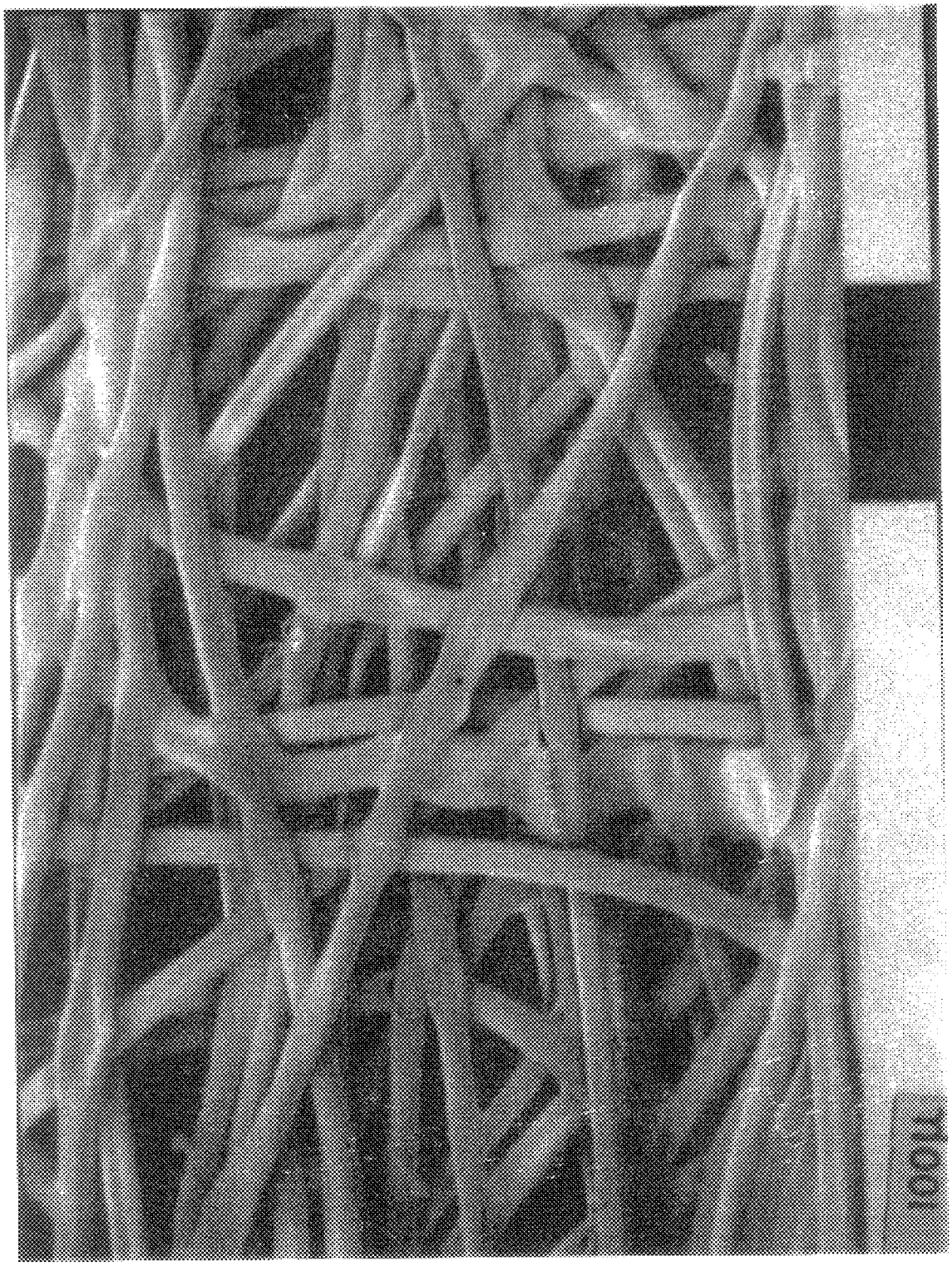
FIG. 5 is an Scanning Electron Microscope (SEM) photograph of a 0% sub-denier fiber web in accordance with the prior art.

In FIG. 5, there may be seen a Scanning Electron Microscope (SEM) photograph of a 0% sub-denier fiber web, the denier of all fibers in this web being 1.5. This type of web has been used in prior art release agent delivery systems for electrophotographic printers.

Figure 6:
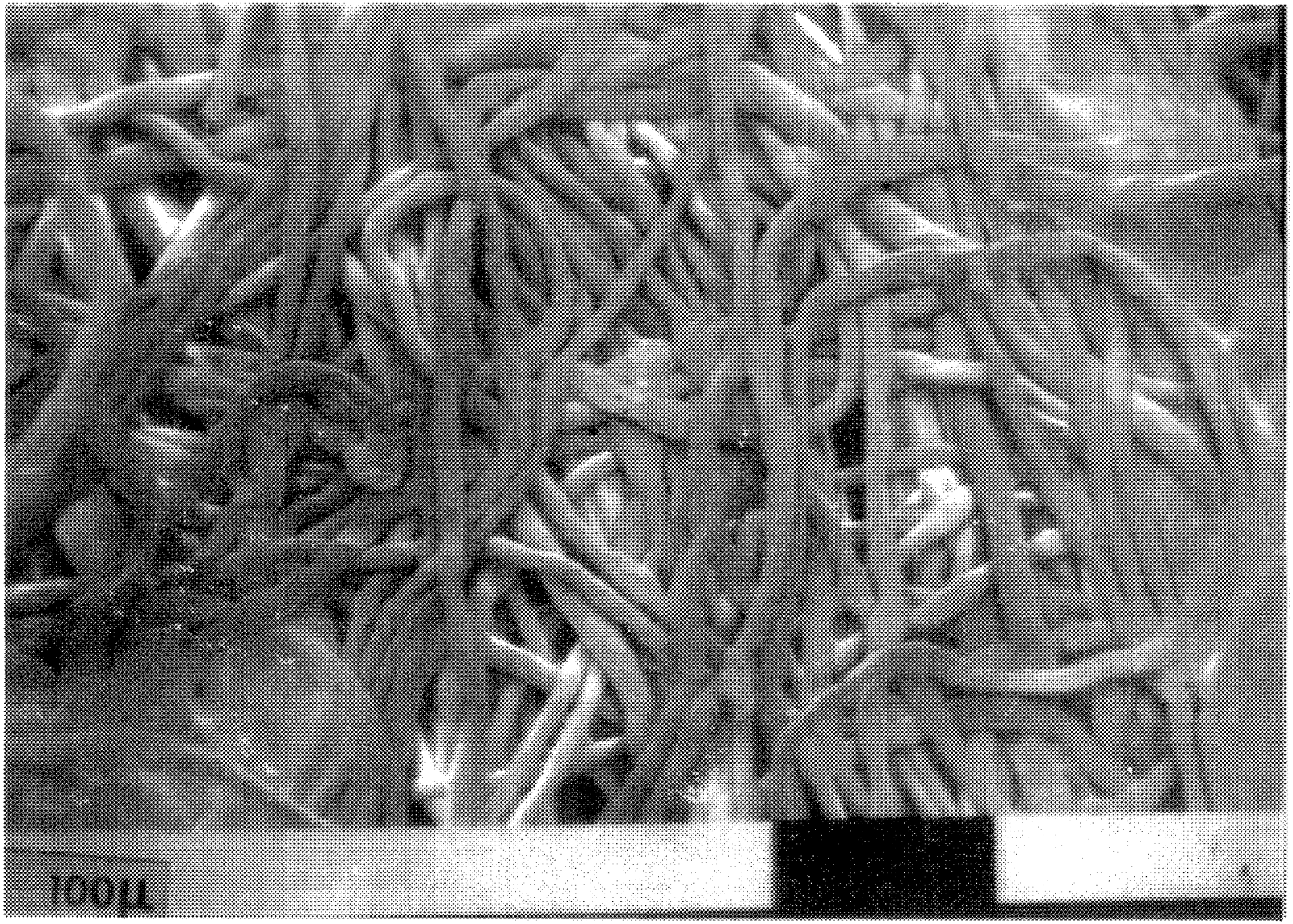
FIG. 6 is an Scanning Electron Microscope (SEM) photograph of a 100% sub-denier fiber web useable in the release agent delivery system in accordance with the present invention.

Now turning to FIG. 6, there may be seen a SEM photograph of a 100% sub-denier fiber web that is useable in the release agent delivery system of the present invention. The composition of the fibers is this web is 80% 0.7 denier fiber and 20% 0.8 denier fiber. This type of non-woven thermally bonded sub-denier fiber web is utilized in the release agent delivery system for electrophotographic printers in accordance with the present invention.

The substantially sub-denier fiber, non-woven textile can be produced using various processing methodologies such as thermal bonding, spun bonding, and hydroentanglement. The preferred method of non-woven textile manufacturing is thermal bonding. Such manufacturing processes are generally well known to those skilled in the art. The fibers of these textiles preferably are Aramid, polyester, Imide, PTFE, PPS, viscose rayon, or a blend of these fibers. The linear density of these fibers ranges between 0.05 denier and 2 denier, and preferably between 0.5 denier and 1.0 denier. The textiles' area weight is typically between 10 and 150 grams per square meter (gsm), and preferably ranges from 15 to 100 gsm. The textiles' thickness is typically between 0.025 mm and 0.450 mm. The preferred textile thickness ranges from 0.035 mm to 0.300 mm.

The non-woven textiles are first formed using the processing technologies discussed above. Once they are formed, the textiles are then slit into a size suitable for supplying oil to a fuser apparatus in an electrophotographic printing machine. These sizes range from 0.2 meters wide by 1.0 meter long to 1.0 Meter wide by 100 Meters long. The next step is typically impregnating the non-woven textile with a fuser release fluid such as silicone oil. Most commonly silicone oil with a viscosity between the range of 50 and 100,000 centistoke is utilized as the fuser release fluid.

The fuser release oil impregnated non-woven thermally bonded essential sub-denier textiles are then incorporated in a release agent delivery device such as the one depicted in FIG. 1. Again, the release agent impregnated web 16 is compressed via a spring mounted compression roller 20 which squeezes release agent out of the web 16 onto the fuser roller 22, more specifically the fuser roller surface 24. The page carrying the unfused toner enters a nip point between the fuser roller 22 and the pressure roller 28 and exits this nip point as a printed page with fused toner 30. The toner becomes fused onto the printed page due to the exerted pressure and temperature exposure at the nip point between the fuser roller 22 and the pressure roll 28. Residual toner 32 is then carried on the fuser roller 22 and transferred to the exiting web surface 34.

As discussed above, and as depicted schematically in FIG. 4, the utilization of a non-woven thermally bonded textile of substantially sub-denier fibers in a toner release agent in accordance with the present invention facilitates the production of an electrophotographically produced print that has a much greatly improved appearance when compared to prints made using prior art textile webs of greater than 1 denier fibers. The use of the substantially sub-denier fiber textile webs imparts a much more uniform coating of release agent to the surface of the fuser roll that was able to be accomplished in the prior art. As discussed above, this much greater uniformity in release agent coating applied to the fuser roller by the sub-denier fiber web accomplishes a much more uniform application of release agent to the paper and a much finer pattern of matte and glossy finish areas in the resultant electrophotographic print.

EXAMPLES

1) A thermal bonded textile was manufactured using 80% 0.7 denier Polyester fiber and 20% 0.8 denier Aramid fiber. The web was manufactured to an area weight of 24 grams/square meter with a thickness of 0.063 mm. The material was then slit to a width of 222 mm The dry slit web was then impregnated with 17 grams/square meter of 1000 Centistoke viscosity silicone oil as manufactured by Dow Corning under the brand name 200 fluid. The impregnated web was then wound onto a metal shaft to a length of 12.34 meters, forming what is known as the supply spool. Another metal shaft was attached to the loose end of the web using pressure sensitive adhesive, forming what is known as the take-up shaft end. Both metal shafts were then inserted into a Tektronix Model Phaser 560 web cartridge and placed into a Model Phaser 560 printer.

To determine the micro-uniformity of oil laydown produced on a electrophotographic print, one common methodology is known as toner dust testing. The toner dust testing procedure used for the web in accordance with example 1 is as follows:

a) The Model Phaser 560 printing system is cleaned of any residual oil by removing the web cartridge and running 10 blank pages through the printer.

b) The printer is returned to operating condition by installing the web to be tested; i.e. the web in accordance with example 1, and by running 10 blank pages through the printer. This allows the web under test to deposit its circumferential oil flow pattern onto the fuser roll surface as depicted schematically in FIGS. 2, 3, and 4.

c) An $11^{th}$ blank page is then run through the printer, carefully removed from the printer's exit tray, and placed oil face up on a flat table.

d) Using a container similar to a salt/pepper shaker; i.e. a perforated topped bottle filled with toner, a light covering of toner is sprinkled on the entire page.

e) Once the page is fully covered, it is picked up and shaken vertically to remove excess toner. Upon removal of excess toner, the page's oil pattern will be evident. Dark striations represent the heavy oil regions while light striations represent the light oil regions.

f) To preserve this oil/toner pattern for quantitative analysis, the toner dusted page is carefully inserted into a 0.003×9×11.5 laminating pouch. The page and pouch are then laminated at 120 degrees C. in an Ibico Model EL 12 laminator. The 120 degrees C. is high enough to laminate the pouch to the test page but low enough to avoid melting the toner.

g)To measure the width of the high oil concentration striations on the page, an optical comparator manufactured by S-T Industries Incorporated, Series 20-3600 was used. Sixty consecutive oil striations were measured and data was then statistically analyzed.

2) Comparative Example: The exact process used to determine the uniformity of oil lay-down accomplished by the web of example 1 was followed with the one exception of the textile incorporated in the comparative example. The comparative example textile was a thermal bonded textile manufactured using no sub-denier fiber. This textile was manufactured using 70% 1.5 denier Polyester fibers and 30% 1.5 denier Aramid fibers, a web formulation typically used in prior art release agent delivery systems.

Results

Figure 7:
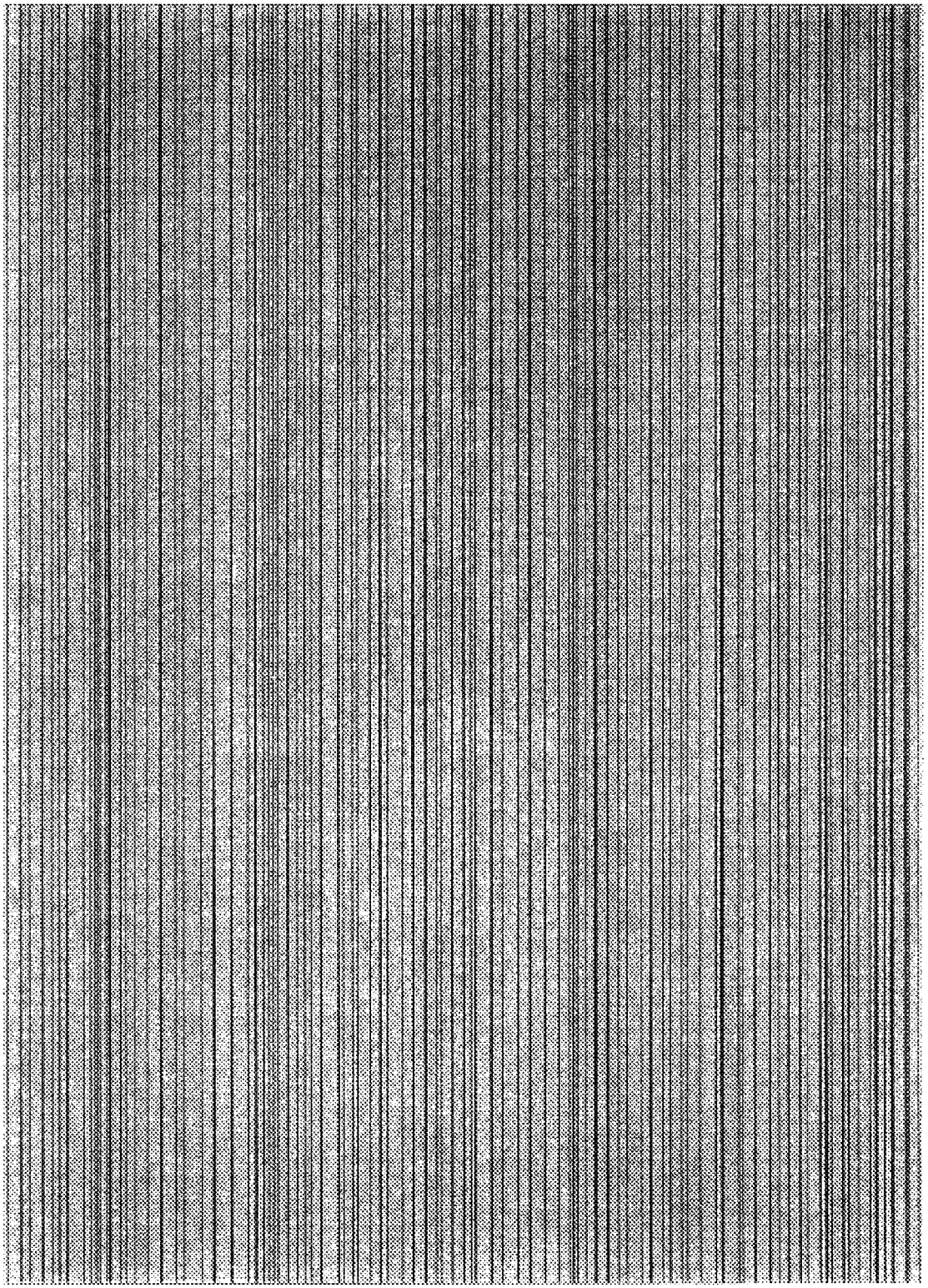
FIG. 7 is a depiction of a toner dust test print from a printer equipped with a 100% sub-denier fiber web in accordance with the present invention.
Figure 8:
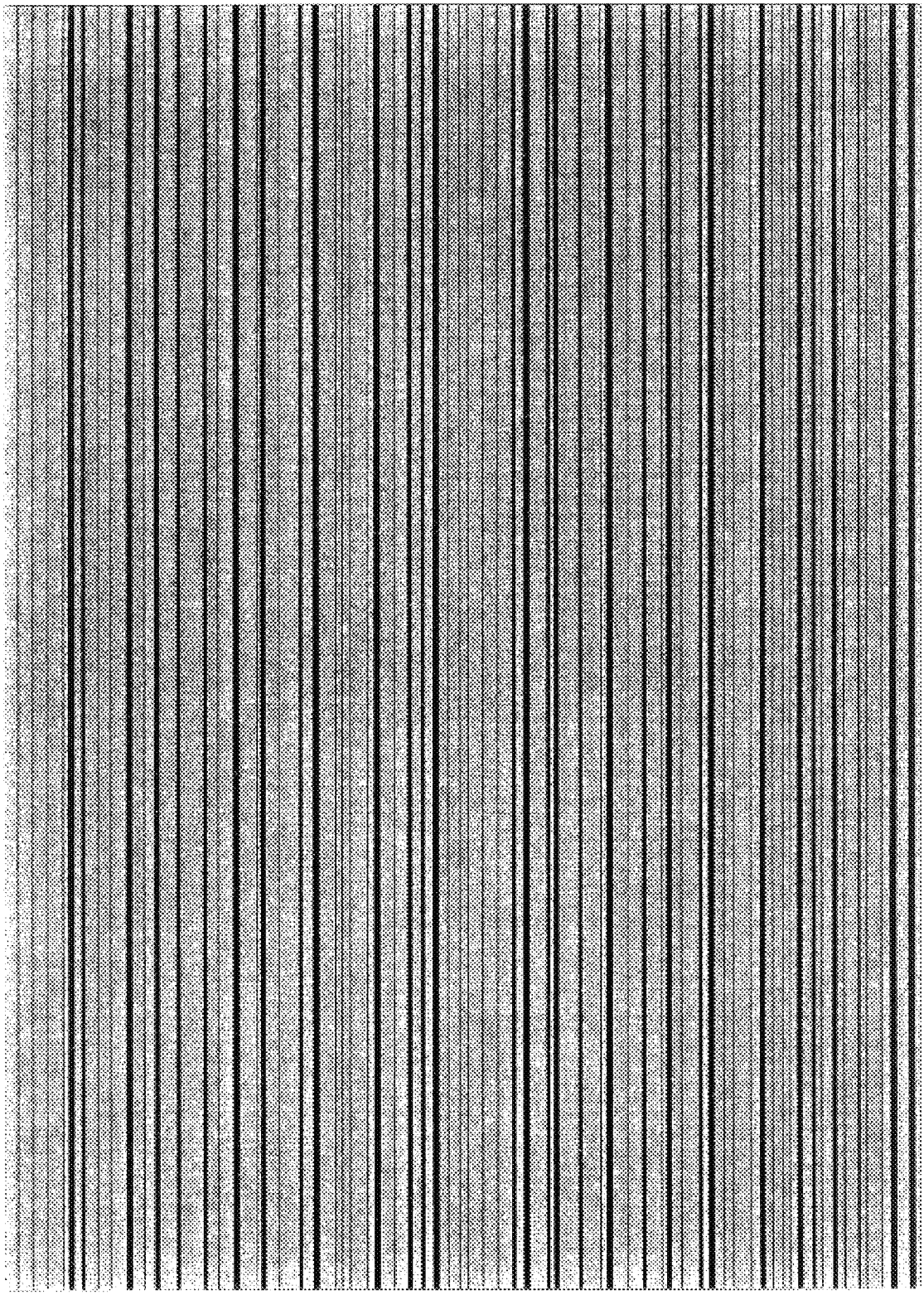
FIG. 8 is a depiction of a toner dust test print from a printer equipped with a 0% sub-denier fiber web in accordance with the prior art.
Figure 9:
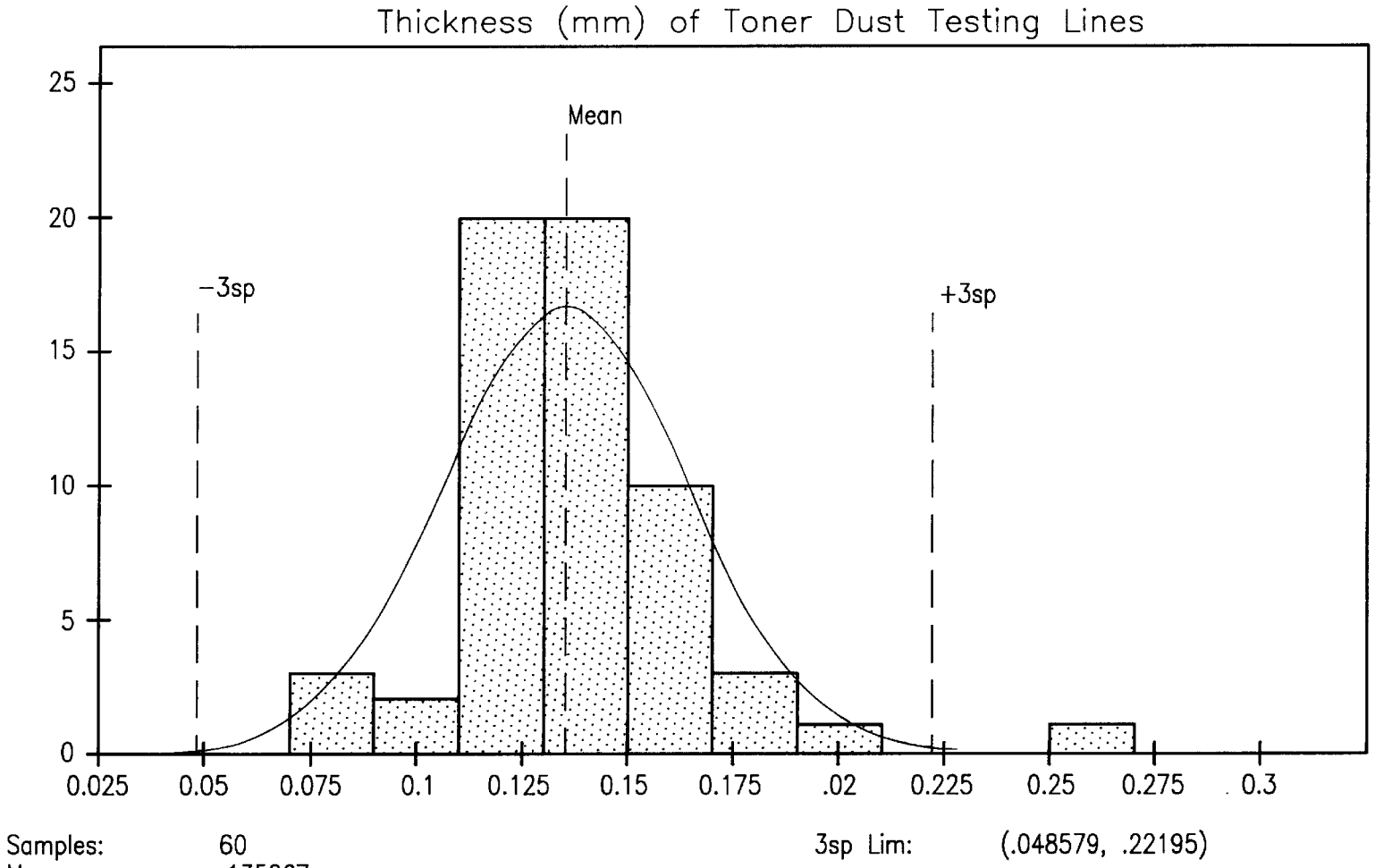
FIG. 9 is a graphical normal distribution representation of the width of dust test lines from a printer equipped with a release agent delivery system using a 100% sub-denier fiber web in accordance with the present invention.
Figure 10:
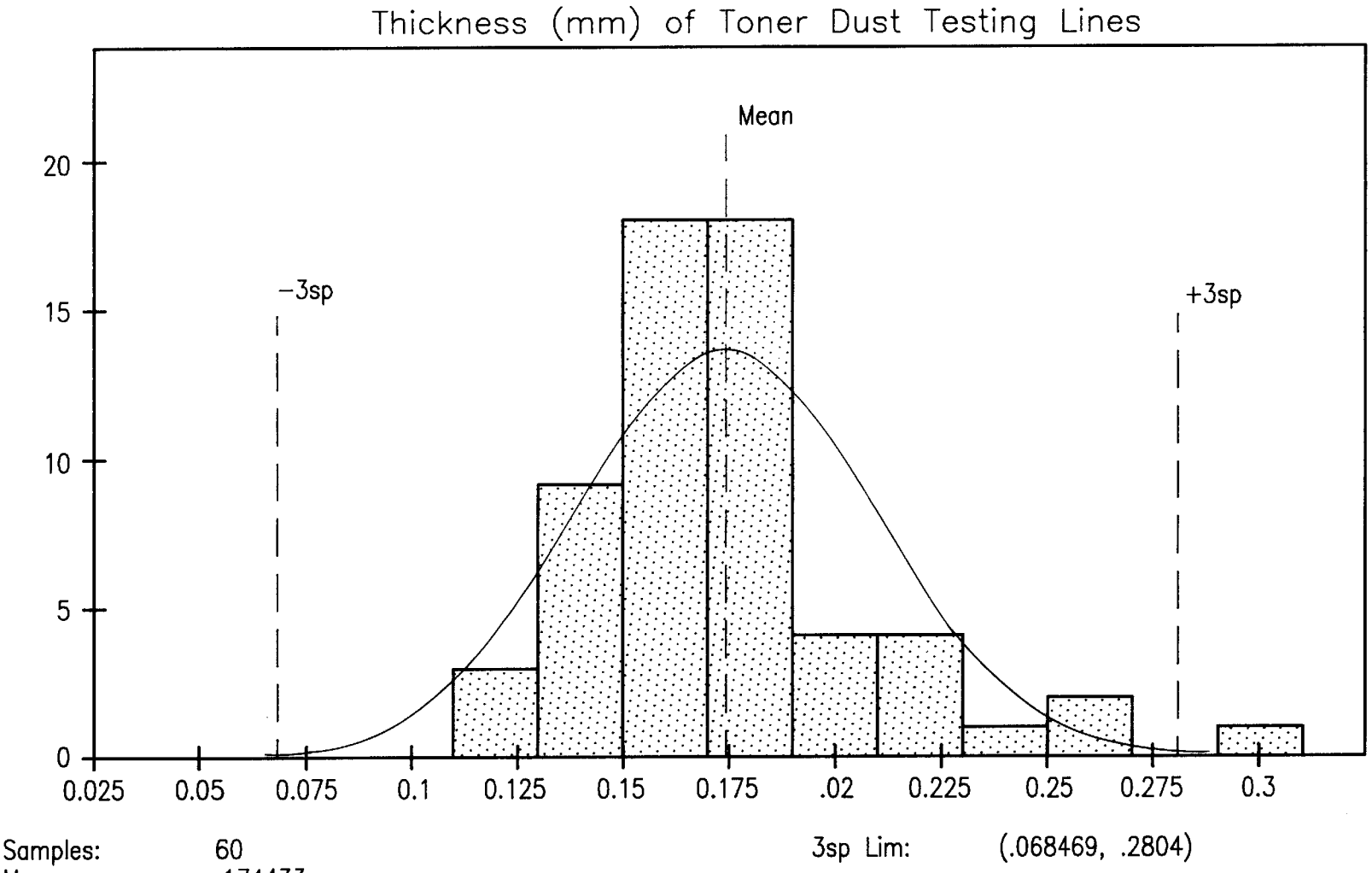
FIG. 10 is a graphical normal distribution representation of the width of dust test lines from a printer equipped with a release agent delivery system using a 0% sub-denier fiber web in accordance with the prior art.

FIG. 7 displays the toner dust testing output from the release agent delivery system using the non-woven thermal bonded sub-denier fiber web of example 1. FIG. 8 displays the toner dust testing output of the prior art textile web using no sub-denier fiber, as described in example 2. FIG. 9 depicts the normal distribution representation of the dust test line widths from the 100% sub-denier fiber web; i.e. the web in accordance with example 1. The average dust test line width created by the sub-denier fiber web was 0.135267 mm. FIG. 10 depicts the normal distribution representation of the dust test line widths from a 0% sub-denier fiber web; i.e. a web in accordance with example 2. The average dust test line width created by the greater than 1.0 denier web was 0.174433 mm The release agent delivery system using the sub-denier web in accordance with the present invention showed a 22% decrease in oil bar width. To establish that the measurement differences between the two sets of data was statistically significant, both sets of data were analyzed using the statistical method commonly known as a students t-test. The result of the t-test against the data depicted in FIGS. 9 and 10 showed the two populations of data to be statistically significantly different with 99.9% confidence.

It will thus be seen that the release agent delivery system, using a non-woven thermally bonded web of substantially sub-denier fibers, in accordance with the present invention, results in the production of a much finer oil line pattern on a fuser roller and hence on a print generated by an electrophotographic printer. The quality of the resultant print is much better than the quality of a print generated by an electrophotographic printer using a prior art web having no sub-denier fibers. The significantly reduced line widths formed by the release agent delivery system in accordance with the present invention result in print with a much smaller or narrower width pattern of matte and glossy finish lines. As discussed above, this is the result of the much more uniform silicone oil distribution pattern resulting from the utilization of the sub-denier fiber web as the release agent distribution in accordance with the present invention.

While a preferred embodiment of a release agent delivery system for electrostatic printers in accordance with the present invention has been set forth fully and completely hereinabove, it will be apparent to one of skill in the art that a number of changes in, for example the type of substrate being printed on, the specific copy machine being used, and the like could be made without departing from the true spirit and scope of the present invention which is accordingly to be limited only by the following claims.

What is claimed is:

1. A particle release agent delivery system useable in a fuser system of an electrophotographic printer comprising:

a particle release agent delivery device;

a non-woven textile web of fibers carried by said particle release agent delivery device, said non-woven textile web of fibers being comprised of greater than 55% by weight of said fibers which are sub-denier in size and being adapted to deliver a particle release agent to the fuser system of an electrophotographic printer; and a particle release agent impregnated in said non-woven textile web, said particle release agent being delivered to the fuser system of an electrophotographic printer by said non-woven textile web of fibers and being applied to the fuser system by said non-woven textile web of fibers in a uniform application pattern of said particle release agent from said non-woven textile web comprised of greater than 55% by weight sub-denier fibers.

2. The release agent delivery system of claim 1 wherein said non-woven textile web is entirely formed of said sub-denier fibers.

3. The release agent delivery system of claim 1 wherein said fibers range between 0.05 denier and 2 denier.

4. The release agent delivery system of claim 3 wherein said fibers range between 0.5 denier and 1.0 denier.

5. The release agent delivery system of claim 4 wherein said non-woven textile web has an area weight of between 10 and 150 grams per square meter.

6. The release agent delivery system of claim 4 wherein said fibers are 80% 0.7 denier fibers and 20% 0.8 denier fibers.

7. The release agent delivery system of claim 6 wherein said non-woven textile web has an area weight of between 15 and 100 grams per square meter.

8. The release agent delivery system of claim 1 wherein said particle release agent is silicone oil.

9. The release agent delivery system of claim 8 wherein said silicone oil has a viscosity between 50 and 100,000 centistoke.

10. The release agent delivery system of claim 1 wherein said non-woven textile web is thermally bonded.

11. A method for delivering a particle release agent to a fuser system in an electrophotographic printer including:

providing a particle release agent delivery device;

providing a non-woven textile web of fibers comprised of greater than 55% sub-denier fibers by weight;

impregnating said non-woven textile web of fibers with a particle release agent;

placing said non-woven textile web of fibers in said particle release agent delivery device;

using said non-woven textile web of fibers for delivering said particle release agent to the fuser system in the electrophotographic printer; and applying said particle release agent to the fuser system in a uniform application pattern from said non-woven textile web of fibers comprised of greater than 55% sub-denier fibers by weight in said release agent delivery device.

12. The method of claim 11 further including forming said non-woven textile web using entirely sub-denier fibers.

13. The method of claim 12 further including selecting said sub-denier fibers from fibers ranging between 0.5 denier and 1.0 denier.

14. The method of claim 11 further including using silicone oil as said particle release agent.

15. A release agent delivery system for an electrophotographic printer comprising:

a release agent delivery device;

a non-woven textile web of fibers carried by said release agent delivery device, said fibers being 80% 0.7 denier fibers and 20% 0.8 denier fibers; and a particle release agent impregnated in said web.

16. The release agent delivery system of claim 15 wherein said non-woven textile web has an area weight of between 15 and 100 grams per square meter.

* * * * *